United States Patent [19]

Perry, Jr.

[11] 4,326,280

[45] Apr. 20, 1982

[54] WATCH MOUNTING DEVICE

[76] Inventor: Dale E. Perry, Jr., 4352 Brown Rd., Oregon, Ohio 43616

[21] Appl. No.: 133,454

[22] Filed: Mar. 24, 1980

[51] Int. Cl.[3] ..... G04B 37/00; A45C 11/10

[52] U.S. Cl. ..... 368/277; 224/163; 224/180

[58] Field of Search ..... 368/276-279, 368/282-283, 301, 303, 316; 224/163, 170, 180, 152

[56] References Cited

U.S. PATENT DOCUMENTS

| | | | |
|---|---|---|---|
| 1,479,008 | 1/1924 | Powers | 224/152 |
| 1,493,248 | 5/1924 | Davidoff | 368/283 |
| 1,645,633 | 10/1927 | Wakefield | 368/277 |
| 1,965,095 | 7/1934 | Boucher | 368/277 |
| 2,013,575 | 9/1935 | Moffatt | 368/277 |
| 2,182,194 | 12/1939 | Blau | 368/277 |
| 2,509,428 | 5/1950 | Greene | 224/152 |
| 2,551,515 | 6/1951 | Tschrif | 224/180 |
| 3,214,685 | 10/1965 | Brenner | 224/152 |

FOREIGN PATENT DOCUMENTS

| | | | |
|---|---|---|---|
| 208583 | 2/1940 | Switzerland | 368/283 |
| 229974 | 3/1925 | United Kingdom | 368/277 |
| 298503 | 10/1928 | United Kingdom | 368/283 |
| 636342 | 4/1950 | United Kingdom | 368/277 |

*Primary Examiner*—Vit W. Miska

*Attorney, Agent, or Firm*—Wilson, Fraser, Barker & Clemens

[57] ABSTRACT

The invention provides a device for convenient mounting of an ordinary wrist watch on a belt. The watch is mounted within a case having a belt bracket and a hinged protective cover. The watch is hingedly mounted on one of its conventional strap pins to the inside of the protective cover. Both hinged mountings are spring biased to urge the protective cover and watch to a normal closed position. The other conventional strap pin of the watch retains a strap which hangs freely from the case, to provide a convenient handle to open the case and pull the watch into view.

6 Claims, 4 Drawing Figures

WATCH MOUNTING DEVICE

BACKGROUND OF THE INVENTION

For various reasons, wrist watches are undesirable for many people. Some are allergic to metal bands, others simply find watch straps to be uncomfortable. During many common activities, a wrist watch will be exposed to moisture, or other corrosive environments. Wrist watches worn by factory workers and construction workers are especially liable to damage.

Conventional pocket watches obviate some of these problems, but present other problems of their own. A pocket watch is typically attached to a belt by a fob which forms a dangling loop that could be a hazard in many occupations. Further, reading and replacing a pocket watch cannot be as quickly and conveniently done as is desirable.

There are several devices in the prior art for pivotally mounting and protecting watches. However, none of the following prior art devices disclose the unique features of the instant invention, which provides for both protection and convenient viewing of an ordinary wrist watch.

U.S. Pat. No. 2,182,194 to Blau discloses a protective case for a watch, comprising a base and a hinged cover on which the watch is fixed. However, there is not disclosed any convenient means for mounting a conventional wrist watch on such a case, by utilizing the watches conventional strap and strap pins. Further, although the Blau disclosure mentions the possibility of pivotally mounting the watch on the cover, in order to make the watch stem more accessible, there is no disclosure of the particular arrangement of hinged mounting of the present invention, in which the watch is hingedly mounted to the cover at the end opposite the covers hinged mounting to the base. This arrangement, not disclosed by Blau, permits the watch to be extended further from the base, thereby providing for easier viewing.

Several other U.S. Patents disclose devices for mounting a watch on a belt, having various pivoting arrangements, but without any protective enclosure. Included in this group are the following patents: U.S. Pat. Nos. 2,509,428, to Greene; 1,479,008, to Powers; 2,551,515, to Tschirf; 3,214,685, to Brenner.

Accordingly, there is a need for a device that will permit an ordinary wrist watch to be attached to a belt, protected from damage, easily pulled out for reading, and automatically retracted to a protected position.

SUMMARY OF THE INVENTION

The invention comprises a protective device for mounting an ordinary wrist watch on a belt. A case is formed with a sleeve on the back thereof for mounting on a belt. At the front of the case is a protective cover which is hinge-mounted at its top for pivotal opening upwardly and outwardly relative to the wearer. The hinge is spring biased to a normal closed position. An ordinary wrist watch is mounted within the case in an upright position, with its back plate against the inside of the protective cover. The lower of the watch's coventional strap mounting pins is hingedly mounted at the bottom of the protective covering. This mounting is also spring biased, so that the watch is urged to its normal retracted position abutting the inside of the protective cover. A standard watch strap is conventionally attached to the other strap mounting pin, and extends downwardly outside the case. Pulling on this strap causes the cover to pivot upward and the watch to pivot outward until its face is in a generally horizontal plane, visible for convenient reading. When the strap is released, the spring biases return the watch to its normal retracted and protected position.

BRIEF DESCRIPTION OF THE DRAWINGS

The above objects and advantages of the invention will become readily apparent to one skilled in the art from reading the following detailed description of an embodiment of the invention when considered in light of the accompanying drawings, in which.

DESCRIPTION OF PREFERRED EMBODIMENT

Figure 1:
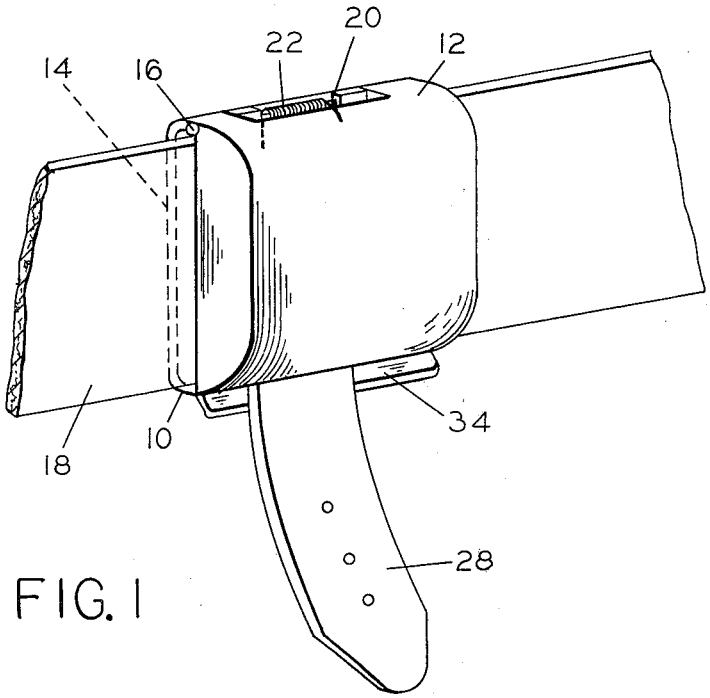
FIG. 1 is a perspective view of a watch case embodying the salient features of the present invention, in its normal closed position.

As illustrated in the drawings, a watch case embodying this invention includes a base plate 10 and a hinged cover 12. The base plate 10 has a pair of outwardly projecting side panels 13. A notch 11 may be formed in a side panel 13 to provide clearance for a stem of an oversized watch. A looped member 14 is attached to the back of the base plate 10 and cooperates with the base plate 10 to define a belt receiving slot 16, sized to receive a belt 18.

The protective cover 12 is pivotally mounted on a pin 20 at the top of the base 10. A conventional helical torsion spring 22 normally biases the cover 12 to the closed position illustrated in FIG. 1.

A conventional wrist watch 24, to be mounted in the watch case, has a lower strap mounting pin 26 and an upper strap mounting pin. A conventional watch strap 28 is retained on the upper strap mounting pin.

Figure 3:
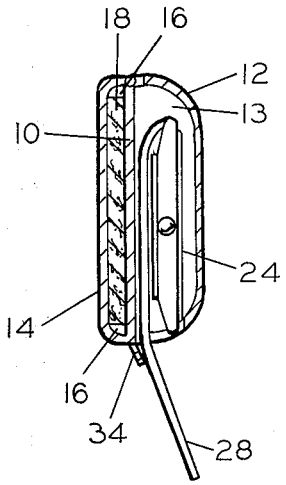
FIG. 3 is a vertical sectional view, illustrating the orientation of the watch within the case, in a closed position.

The watch 24 is pivotally mounted on its lower pin 26 to the lower end of the cover 12. The pin 26 is mounted by insertion through a hole provided in a tab 30 extending from the bottom of the cover 12. The watch 24 is oriented so that its back plate is against the inside of the cover 12 when the watch 24 is retracted within the case as illustrated in FIG. 3.

The pivotal mounting of the watch 24 to the cover 12 is also biased by a conventional torsion spring 32, which urges the watch 24 inwardly against the cover 12. In this retracted position, the watch strap 28 lies against the watch face, and its free end protrudes from the bottom of the case, as best illustrated in FIG. 3. It will be appreciated that in the normally closed position, the watch strap 28 functions to additionally provide a cushioning protective layer between the face of the watch 24 and the adjacent inner surface of the base plate 10.

Figure 2:
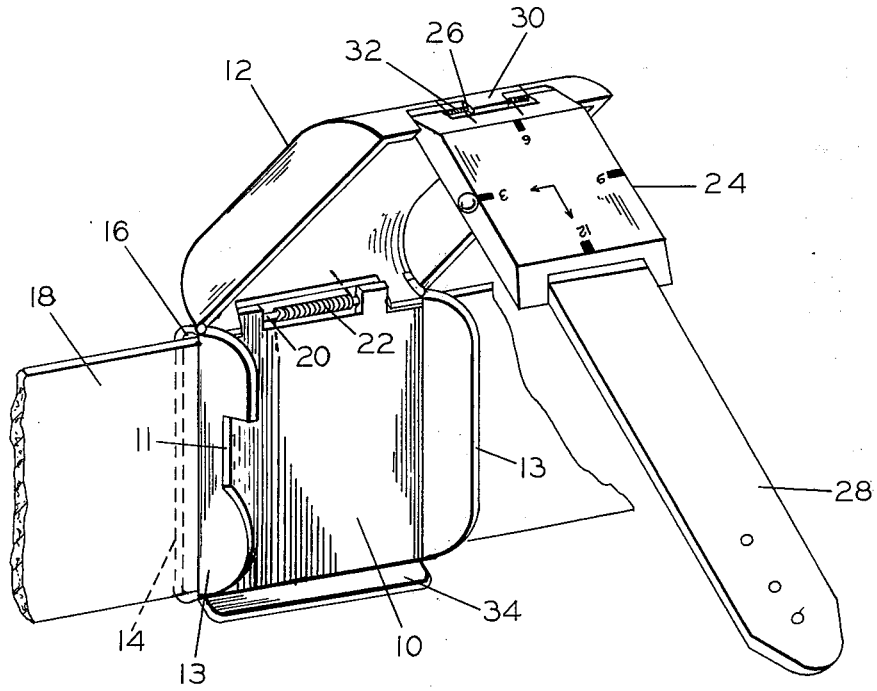
FIG. 2 is a perspective view similar to FIG. 1, showing the case opened for viewing of the watch.

To expose the watch 24 for viewing, the strap 28 is pulled upwardly and outwardly. By this motion, the cover 12 is pivoted upwardly and outwardly on the hinge pin 20 and the watch 24 is pivoted outwardly until its face is in a position for viewing, as illustrated in FIG. 2. The watch 24 may thus be pulled to a generally horizontal viewing position in which it is outwardly spaced from the base plate 10, and from the wearer, by the length of the cover 12. The extension of the watch 24 on the cover 12 permits the watch 24 to be easily viewed. When the strap 28 is released, the springs 22 and 32 function to retract the watch 24, the strap 28 and the cover 12 to the normally closed orientation illustrated in FIG. 3.

If desired, the inside of the cover 10 could be lined with resilient material, to protect the watch 24 and militate against allowing the watch 24 to snap into harsh contact with the base 10 or the cover 12. It will be understood that the base 10 and the associated cover 12 may be formed of stamped sheet metal material, or a plastic material, for example.

Figure 4:
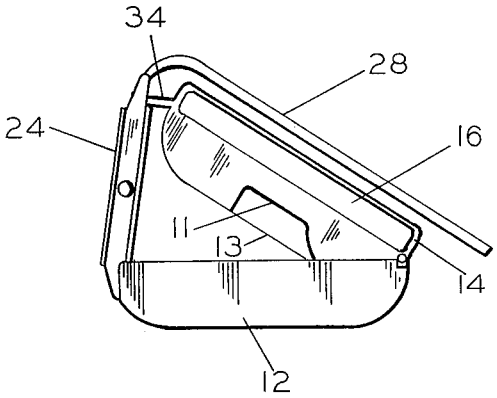
FIG. 4 is a side elevational view of a watch case embodying the present invention, showing the case detached from a belt, and used as a watch stand.

When detached from a belt, the watch case may also be used as a watch stand, as illustrated in FIG. 4. When used as a stand, the outer surface of the cover 12 rests on a suitable supporting surface, such as a nightstand, for example. The watch 24 is pivoted upwardly and outwardly, and is maintained in such position against the bias of the spring 32 by the base plate 10, which functions as a supporting member therefor. A flange 34 is formed to extend from an edge of the base 10 opposite the edge containing the pin 20 and is adapted to rest against the region between the mounting pin of the strap 28 and the adjacent portion of the watch. This spring-biased interengagement of the flange 34 and the watch 24 maintains the watch 24 and the base 10 in the self-supporting configuration illustrated in FIG. 4.

From the foregoing, it may be seen that the invention provides for convenient mounting of an ordinary wrist watch. The watch is completely protected, and may be viewed and retracted with a minimum of manipulation.

In accordance with the provisions of the patent statutes, the principle and mode of operation of the apparatus have been explained and what is considered to represent its best embodiment has been illustrated and described. It should, however, be understood that the invention may be practiced otherwise than as specifically illustrated and described without departing from its spirit or scope.

I claim:

1. A watch mounting device adapted to be mounted on an article of wearing apparel, comprising:

a. a base plate mounted on the wearing apparel;
b. a watch carrying cover;
c. first hinge means pivotally connecting one end of said cover along one marginal edge of said base plate;
d. first spring means normally urging said cover against said base plate;
e. a watch;
f. second hinge means pivotally connecting one end of said watch to the opposite end of said cover;
g. second spring means normally urging said watch to a position within said cover; and
h. grasping means attached to the opposite end of said watch and extending from within and beyond said cover.

2. The invention defined in claim 1 including means for mounting said base plate on the article of wearing apparel and comprising a looped member extending from a surface of said base plate for receiving a belt.

3. The invention defined in claim 1 wherein said first hinge means for pivotally attaching said cover to said base plate is coupled between upper edges of said cover and said base plate.

4. The invention defined in claim 1 wherein said second hinge means for pivotally attaching said watch to said cover is coupled between a lower edge of said cover and said watch.

5. The invention defined in claim 1 wherein said base plate includes a projecting flange arranged to selectively engage the watch at a point spaced from said hinge means coupled between said cover and said watch, whereby said watch and said cover may be maintained in an open configuration, against the bias of said spring means.

6. The invention defined in claim 1 wherein said grasping means comprises a flexible strap having an unattached end protruding from within said cover.

* * * * *